US009460614B2

(12) United States Patent
Wiebel et al.

(10) Patent No.: US 9,460,614 B2
(45) Date of Patent: Oct. 4, 2016

(54) METHOD AND APPARATUS FOR DETERMINING TRAFFIC STATUS

(71) Applicant: Bayerische Motoren Werke Aktiengesellschaft, Munich (DE)

(72) Inventors: Stefan Wiebel, Munich (DE); Heidrun Belzner, Seefeld (DE); Christian Gerstberger, Germering (DE); Markus Gassner, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/491,613

(22) Filed: Sep. 19, 2014

(65) Prior Publication Data

US 2015/0012206 A1 Jan. 8, 2015

Related U.S. Application Data

(63) Continuation of application No. PCT/EP2013/053429, filed on Feb. 21, 2013.

(30) Foreign Application Priority Data

Mar. 21, 2012 (DE) ..... 10 2012 204 542

(51) Int. Cl.
*G08G 1/0967* (2006.01)
*G08G 1/01* (2006.01)

(52) U.S. Cl.
CPC ..... *G08G 1/0112* (2013.01); *G08G 1/0133* (2013.01); *G08G 1/0141* (2013.01); *G08G 1/096716* (2013.01); *G08G 1/096741* (2013.01); *G08G 1/096775* (2013.01)

(58) Field of Classification Search
CPC ..... B60W 40/04; B60W 2550/20; B60W 2550/40; G08G 1/0112; G08G 1/0104; G08G 1/0133; G08G 1/0141; G08G 1/096716; G08G 1/096741; G08G 1/096775
USPC ..... 701/119; 340/992
See application file for complete search history.

(56) References Cited

U.S. PATENT DOCUMENTS 6,092,020 A * 7/2000 Fastenrath ..... G08G 1/0104 340/992
8,229,644 B2 7/2012 Boecker et al.
(Continued)

FOREIGN PATENT DOCUMENTS

CN 101729872 A 6/2010
CN 102222407 A 10/2011
(Continued)

OTHER PUBLICATIONS

International Search Report dated May 24, 2013 (Three (3) pages).
(Continued)

*Primary Examiner* — Adam Tissot
(74) *Attorney, Agent, or Firm* — Crowell & Moring LLP

(57) ABSTRACT

To ascertain traffic status data, a speed of a vehicle is acquired multiple times at predefined time intervals. The respective acquired speed is assigned to a first speed range when the respective acquired speed of the vehicle is greater than at least one predefined speed threshold. Furthermore, a first count is increased when the respective acquired speed is assigned to the first speed range. The respective acquired speed is assigned to a second speed range when the respective acquired speed of the vehicle is less than the at least one speed threshold, and a second count is increased when the respective acquired speed is assigned to the second speed range, wherein a holding phase is recognized while the respective acquired speed has a speed value in a predefined range around the value zero once or multiple times in succession. During the recognized holding phase, the acquired speeds having the speed value in the predefined range around the value zero are not taken into consideration for a predefined non-consideration number of speed acquisition periods with respect to the adaptation of the second count.

19 Claims, 6 Drawing Sheets

(56) References Cited

U.S. PATENT DOCUMENTS

| | | | | |
|---|---|---|---|---|
| 2006/0287808 | A1 | 12/2006 | Breitenberger et al. | |
| 2009/0299598 | A1* | 12/2009 | Boecker ..... | B60W 30/16 701/96 |

FOREIGN PATENT DOCUMENTS

| | | | |
|---|---|---|---|
| DE | 10 2005 050 277 | A1 | 4/2007 |
| DE | 10 2008 003 039 | A1 | 7/2009 |
| DE | 10 2009 032 730 | A1 | 4/2010 |
| EP | 1 262 934 | A2 | 12/2002 |
| EP | 1 695 320 | B1 | 8/2006 |
| WO | WO 2005/064564 | A1 | 7/2005 |
| WO | WO 2005/064567 | A1 | 7/2005 |
| WO | WO 2005/064568 | A1 | 7/2005 |

OTHER PUBLICATIONS

German Search Report dated Nov. 22, 2012, with Statement of Relevancy (Six (6) pages).

Chinese Office Action issued in Chinese counterpart application No. 201380015221.X dated Aug. 27, 2015, with partial English translation (Eighteen (18) pages).

* cited by examiner

METHOD AND APPARATUS FOR DETERMINING TRAFFIC STATUS

CROSS REFERENCE TO RELATED APPLICATIONS

This application is a continuation of PCT International Application No. PCT/EP2013/053429, filed Feb. 21, 2013, which claims priority under 35 U.S.C. §119 from German Patent Application No. 10 2012 204 542.2, filed Mar. 21, 2012, the entire disclosures of which are herein expressly incorporated by reference.

BACKGROUND AND SUMMARY OF THE INVENTION

The invention relates to a method and a device for ascertaining a traffic status.

Data which are generated by vehicles, which are currently participating in a traffic situation, are used for current and reliable provision of items of traffic information. These vehicles acquire and transmit so-called floating car data (FCD). In an FCD system, predominantly a GPS receiver and a mobile wireless connection of the vehicle are used for the acquisition of the data. In an XFCD system (extended floating car data), data of all or a plurality of driver assistance systems are taken into consideration. Inter alia, the state of the road and the traffic flow can thus also be acquired, as well as situation-related traffic impairments.

The object on which the invention is based is to provide a method and a corresponding device that allow reliable ascertainment and optionally reliable provision of traffic status data.

The object is achieved by the features of the independent patent claims. Advantageous refinements of the invention are characterized in the dependent claims.

The invention is distinguished by a method and a corresponding device for ascertaining traffic status data. When it is recognized that a vehicle participates in a traffic flow, a speed of the vehicle is acquired multiple times at predefined time intervals. The respective acquired speed is assigned to a first speed range, when the respective acquired speed of the vehicle is greater than at least one predefined speed threshold. Furthermore, a first count is increased when the respective acquired speed is assigned to the first speed range. When the respective acquired speed of the vehicle is less than the at least one speed threshold, the respective acquired speed is assigned to a second speed range and a second count is increased, wherein a holding phase is recognized while the respective acquired speed, once or multiple times in succession, has a speed value in a predefined range around the value zero. During the recognized holding phase, the acquired speeds having the speed value in the predefined range around the value zero are not considered, for a predefined non-consideration number of speed acquisition periods, with respect to the adaptation of the second count. A first traffic status, which represents flowing traffic, is recognized when the first count exceeds a predefined first limiting value before the second count exceeds a predefined second limiting value. A second traffic status, which represents traffic congestion, is recognized when the second count first exceeds the predefined second limiting value before the first count exceeds the predefined first limiting value.

This advantageously allows precise and current ascertainment of the respective traffic status. The progressive ascertainment of the first count and the second count can provide a contribution to improving reliability of the traffic status recognition. It allows it to be reliably recognized whether traffic congestion is present or whether, for example, congestion-free further travel is possible. The at least partial non-consideration of the acquired speeds during the holding phases of the vehicle for the non-consideration number of speed acquisition periods allows frequent holding times, in particular in urban regions, which are not caused by congestion, but rather, for example, are caused by waiting times of traffic signal facilities and/or intersections and normal traffic conditions in a city in particular, can be filtered out. These holding times at traffic signal systems and/or intersection regions are thus not incorrectly recognized as a disturbance, which is caused by traffic congestion. Supplementary intersection region recognition is not necessary.

In each case an acquired current speed can advantageously be used for the ascertainment of the traffic status data. The traffic status recognition can nonetheless be performed sufficiently reliably. Ascertainment of an average speed and provision of data connected thereto are not necessary.

Fundamentally, the first count can alternatively also be decreased if the respective acquired speed is assigned to the first speed range. This then also applies correspondingly for the second count. In this case, conditions which comprise the first or second count are opposite.

In an advantageous embodiment, the acquired speed is an acquired current actual speed of the vehicle. This allows both computing power and also a memory requirement to be reduced.

In a further advantageous embodiment, the non-consideration number per holding phase is fixedly predefined. This allows very simple recognition as to whether the first or the second traffic status is present.

In a further advantageous embodiment, the non-consideration number is ascertained depending on a duration of at least one preceding holding phase of the vehicle and/or depending on a time span which lies between the at least one preceding holding phase and the holding phase. This can provide a contribution to increasing reliability of the traffic status recognition.

In a further advantageous embodiment, the non-consideration number is ascertained depending on a turn signal status of the vehicle and/or a recognized lane, on which the vehicle is located. This can provide a contribution to improving reliability of the traffic status recognition. In particular, it can thus be taken into consideration that a holding phase at a traffic signal system and/or at an intersection is lengthened when the vehicle wishes to turn off, for example, in particular when the vehicle wishes to turn to the left in the case of prescribed right-hand traffic. The vehicle can have a position ascertainment unit, which is implemented to acquire a current position of the vehicle and to assign this position to a lane of a road. The acquired turn signal status can be acquired and provided, for example, by a central control unit.

In a further advantageous embodiment, depending on an acquired position of the vehicle and predefined digital roadmap data, a road and/or a road type is/are ascertained, on which the vehicle is currently moving, and depending on the road or the road type, respectively, the at least one speed threshold is ascertained. The at least one speed threshold can be ascertained simply and in a manner tailored to a driving situation.

In a further advantageous embodiment, when it is recognized that the vehicle is subjected to at least one traffic influence, which results or which is expected to result in a reduction of the speed of the vehicle in relation to a normal speed without such traffic influences, the at least one speed threshold is ascertained depending on the at least one traffic influence. This enables boundary conditions, for example, a weather and/or a road layout, to be taken into consideration when ascertaining the at least one speed threshold, and enables the at least one speed threshold to be adapted to the boundary condition.

In a further advantageous embodiment, the non-consideration number is ascertained depending on an assignment of the current position of the vehicle to an urban or rural region. In particular, the non-consideration number can be fixedly predefined for rural regions and can have the value zero.

In a further advantageous embodiment, dependent on the road or the road type, an upper speed threshold and a lower speed threshold are ascertained. The acquired speed is assigned to the first speed range if the respective acquired speed of the vehicle is greater than the upper speed threshold. If the respective acquired speed of the vehicle is less than the lower speed threshold, the acquired speed is assigned to the second speed range. This can allow better estimation of the traffic situation by way of different speed classes. Thus, falling below the lower speed threshold is an indication that the vehicle is moving or stationary in congestion. A speed of the vehicle which lies in the range between the lower and the upper speed threshold is an indication that the vehicle is moving in a rather undefined status between congestion and free travel. A speed of the vehicle which is higher than the upper speed threshold is finally an indication that the relevant vehicle has free travel. By way of this classification, it is possible to weigh the mentioned statuses differently. This in turn enables substantially reliable congestion recognition also in the case of multiple statuses, which occur during the observation time to decide whether or not congestion is present. Alternatively, the movement or the speed of the vehicle can also be classified in more than three speed classes or speed ranges, respectively. This can be reasonable in particular if it is not only to be differentiated whether or not a vehicle is located in congestion, but rather also it is to be ascertained which points of the congestion are traveled at which speeds on average.

In a further advantageous embodiment, the acquired speed is assigned to the second speed range if it is less than the upper speed threshold and is greater than the lower speed threshold and if the immediately previously acquired speed is assigned to the second speed range. In contrast, the acquired speed is assigned to the first speed range if it is less than the upper speed threshold and is greater than the lower speed threshold and if the immediately previously acquired speed is assigned to the first speed range. This advantageously allows a reliability of a traffic status recognition to be improved. In this manner, it is possible to prevent the first traffic status and the second traffic status from being considered to be recognized alternately as a result of short-term changes of the acquired speeds within only short time intervals. In particular, this allows an acquired current actual speed of the vehicle to be used for the ascertainment of the traffic status data in each case. The traffic status recognition can be performed with sufficient reliability in spite of frequent short-term changes of the current actual speed. An ascertainment of an average speed and a provision of data connected thereto are not necessary.

In a further advantageous embodiment, the acquired speed is equally assigned to the first and second speed range if it is less than the upper speed threshold and is greater than the lower speed threshold. This advantageously allows reliability of traffic status recognition to be improved. In this manner, it is possible to avoid the first traffic status and the second traffic status being recognized alternately as a result of short-term changes of the acquired speeds within only short time intervals.

In a further advantageous embodiment, the acquired speed is assigned to neither the first nor the second speed range when it is less than the upper speed threshold and is greater than the lower speed threshold.

In a further advantageous embodiment, when, upon the respective ascertainment of the second count, the second count exceeds a predefined second threshold value, a predefined first initialization value is assigned to the first count. When, upon the respective ascertainment of the first count, the first count exceeds a predefined first threshold value, a predefined second initialization value is assigned to the second count. This allows a reset of the first and second counts in particular if the corresponding count remains unchanged for a longer time. The first and second initialization values can be zero, for example.

In a further advantageous embodiment, when a change from the first traffic status to the second traffic status or vice versa is recognized and therefore the second traffic status is newly recognized or the first traffic status is newly recognized, respectively, it is checked whether the newly recognized second traffic status or the newly recognized first traffic status, respectively, was already communicated to the vehicle. If it was not already communicated to the vehicle, a data set is ascertained, which describes the changed traffic status. This data set is transmitted to a central unit. Advantageously, this allows an event-oriented and non-redundant data transmission to an institution which reconstructs and displays the traffic situation, for example, a traffic data central office. If the information in the vehicle is already known, a recognized changed traffic status is not ascertained. In this manner, it is possible to correct a traffic report which was transmitted by a service provider to the vehicle. The costs of the data transmission can be kept low.

Exemplary embodiments are explained hereafter on the basis of the schematic drawings.

Other objects, advantages and novel features of the present invention will become apparent from the following detailed description of one or more preferred embodiments when considered in conjunction with the accompanying drawings.

Elements of identical construction or function are provided with identical reference signs in all of the figures.

DETAILED DESCRIPTION OF THE DRAWINGS

Figure 1:
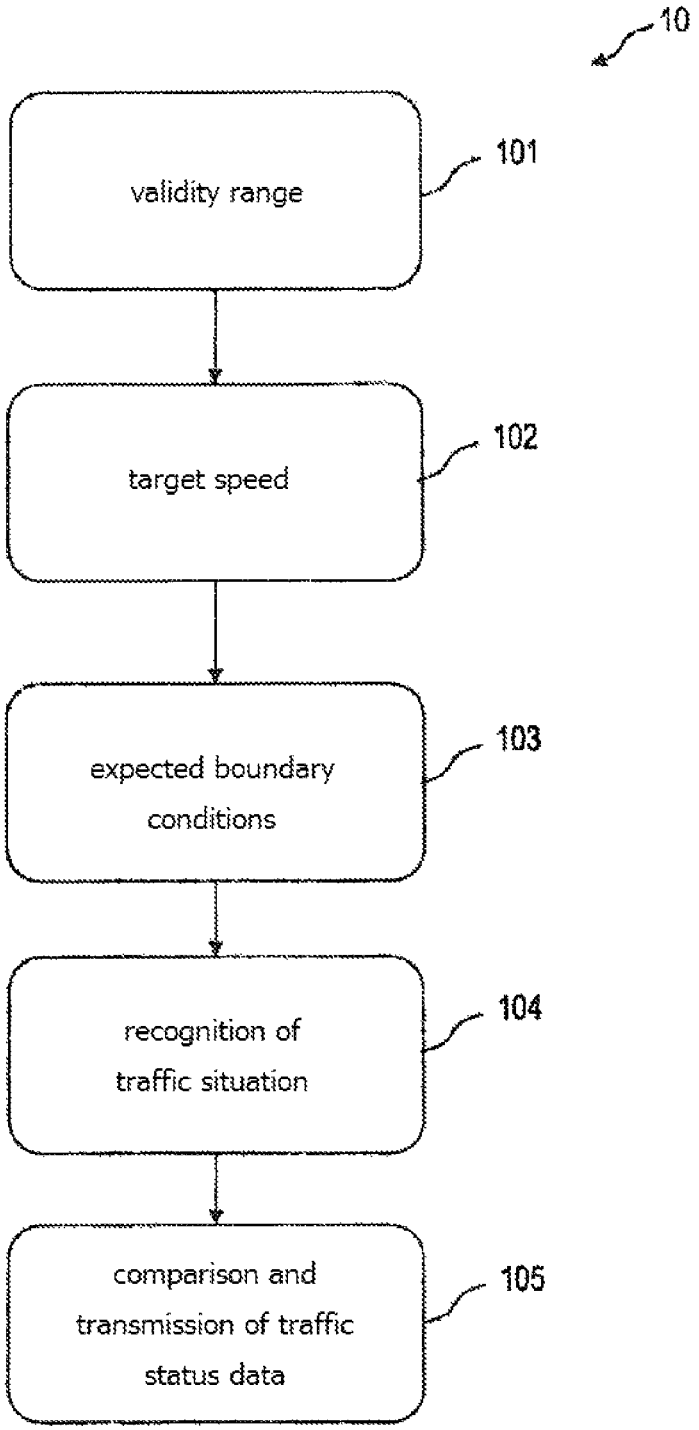
FIG. 1 shows a flow chart of a program for ascertaining and providing traffic status data.

FIG. 1 shows an exemplary flow chart for a program 10 for ascertaining and providing traffic status data. The program 10 comprises multiple program modules 101, 102, 103, 104, 105. The program modules 101, 102, 103, 104, 105 are each implemented to execute various program functions, wherein it is also possible that further program functions are supplemented, one or another program function is replaced by another program function, and/or a program function is not used, for example. The program 10 comprises, for example, a first 101, a second 102, a third 103, and a fourth 104 and also a fifth program module 105, wherein in particular the third 103 and/or fifth program module 105 can optionally be used.

The first program module 101 is implemented, for example, to recognize whether the vehicle is participating in an actual traffic flow and therefore the ascertainment of a traffic status can result in principle in a correct result. For example, this allows driving of the vehicle in an underground garage and/or on a parking lot to be differentiated from driving on a road. One possible embodiment of the first program module 101 is described in the PCT patent application having the international publication number WO 2005/064564 A1 in FIG. 1 and the associated description, in particular on page 6, line 5 to page 9, line 8. The content of FIG. 1 and page 6, line 5 to page 9, line 8 of the PCT application having the international publication number WO 2005/064564 A1 is hereby incorporated.

The second program module 102 is implemented, for example, to ascertain a speed level to be expected. For ascertaining the speed level to be expected, for example, it can be ascertained by means of a digital roadmap, in which a road type and/or a road category is assigned to all roads, wherein a predefined target speed is assigned in each case to the road type or the road category, respectively. Additionally or alternatively, it is possible that a predefined target speed is directly assigned to all roads. The digital roadmap can be stored in a navigation unit, for example. One possible embodiment of the second program module 102 is described in the PCT patent application having the international publication number WO 2005/064564 A1 in FIG. 2 and the associated description, in particular on page 9, line 10 to page 11, line 16. The content of FIG. 2 and page 2, line 8 to page 5, line 10 and page 9, line 10 to page 11, line 16 of the PCT patent application having the international publication number WO 2005/064564 A1 is hereby incorporated.

The third program module 103 is implemented, for example, to ascertain whether the vehicle is subjected to at least one traffic influence, which is expected to result in a reduction of the speed of the vehicle in relation to a normal speed without such traffic influences. The third program module 103 is implemented, for example, to ascertain the boundary conditions of weather and road layout and to adapt the speed level ascertained in the second program module 102, in particular the upper speed threshold vh and the lower speed threshold vl, to the ascertained boundary conditions, for example, rain, snowfall, and/or black ice. Such a traffic influence can be weather-related, for example, as a result of rain, snow, black ice, for example, and/or caused by a road layout, for example, a curvy section. One possible embodiment of the third program module 103 is described in the European patent application having the publication number EP 1 695 320 B1 in FIG. 3 and the associated description, in particular on page 2, line 32 to page 3, line 40 and page 6, line 12 to page 7, line 44. The content of FIG. 3 of page 2, line 32 to page 3, line 40 and of page 6, line 12 to page 7, line 44 of the European patent application having the publication number EP 1 695 320 B1 is hereby incorporated.

The fourth program module 104 is implemented, depending on acquired speeds vc, which are acquired in chronologically predefined intervals, to ascertain a traffic status. The fourth program module 104 will be explained on the basis of FIGS. 3 to 6.

The fifth program module 105 is implemented, when a change from the first traffic status FREE to the second traffic status CONG or vice versa has been recognized and therefore the second traffic status CONG or the first traffic status FREE, respectively, is newly recognized, to check whether the newly recognized second traffic status CONG or the newly recognized first traffic status FREE was already communicated to the vehicle, and if this was not already communicated to the vehicle, to ascertain a data set, which describes the changed traffic status, and to transmit it to a central unit.

Figure 2:
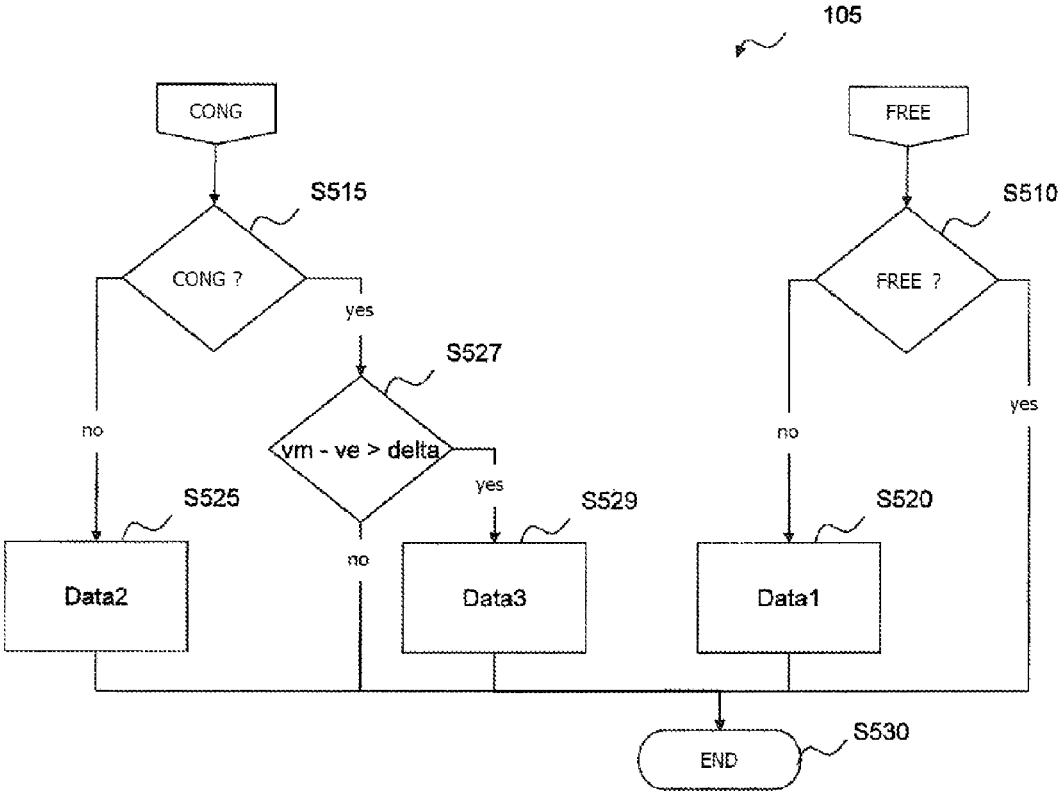
FIG. 2 shows a flow chart of a fifth program module.

One embodiment of the fifth program module 105 is shown in FIG. 2.

In the case in which a change from the second traffic status CONG to the first traffic status FREE was recognized in the fourth program module 104, it is checked in a step S510 of the fifth program module 105 whether the newly recognized first traffic status FREE for the current position of the vehicle was already communicated to the vehicle, and if it was not already communicated to the vehicle, in a step S520, a first data set DATA1 is ascertained, which describes the changed traffic status, in this case the first traffic status FREE, and this is transmitted to a central unit and subsequently the fifth program module 105 ends in a step S530. If it is recognized in a step S510 of the fifth program module 105 that the changed traffic status for the current position of the vehicle is already known in the vehicle, a data set is not transmitted to the central unit, but rather the fifth program module 105 ends in step S530.

In the case in which a change from the first traffic status FREE to the second traffic status CONG was recognized in the fourth program module 104, it is checked in a step S515 of the fifth program module 105 whether the newly recognized second traffic status CONG for the current position of the vehicle was already communicated to the vehicle and, if it was not already communicated to the vehicle, in a step S525, a second data set DATA2 is ascertained and this is transmitted to the central unit and subsequently the fifth program module 105 ends in step S530. If it is recognized in step S515 that the changed traffic state for the current position of the vehicle is already known in the vehicle, in a step S527, a comparison is performed of an acquired current average speed vm of the vehicle to an expected current speed ve, which was already communicated to the vehicle, for example. If the comparison in step S527 has the result that there is no deviation or only a slight deviation between the two speeds ve, vm, the fifth program module 105 is ended directly in step S530. If the comparison in step S527 has the result that there is a noticeable difference between the two speeds ve, vm, a third data set DATA3 is ascertained in a step S529 and this is transmitted to the central unit and subsequently the fifth program module 105 is ended in step S530. In this manner, it is possible to correct a traffic report which was transmitted from a service provider to the vehicle.

Figure 3:
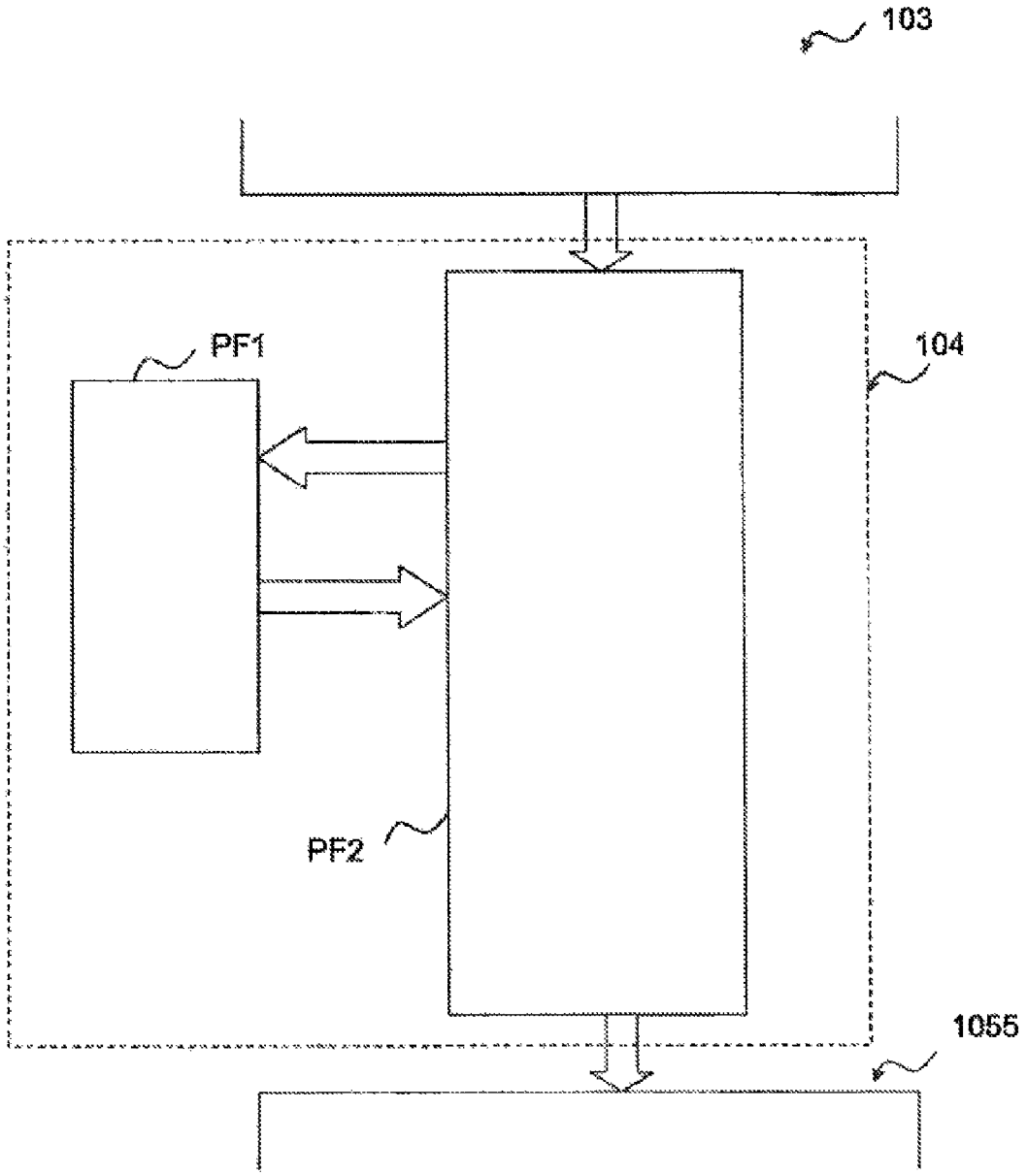
FIG. 3 shows a block diagram of a fourth program module.

FIG. 3 shows a block diagram for the fourth program module 104. The fourth program module 104 comprises a first program function PF1 for a separate consideration of the holding phases Tv0 of the vehicle during the ascertainment of the traffic status data and a second program function PF2 for ascertaining the first count Z1 and the second count Z2 according to a first threshold value method outside the holding phases Tv0 and for recognizing a change from the first traffic status FREE to the second traffic status CONG or vice versa. The program functions PF1, PF2 can have interfaces to the respective other program functions PF1, PF2 of the fourth program module 104, so that, for example, values, assignments, etc. can be transferred.

Figure 4:
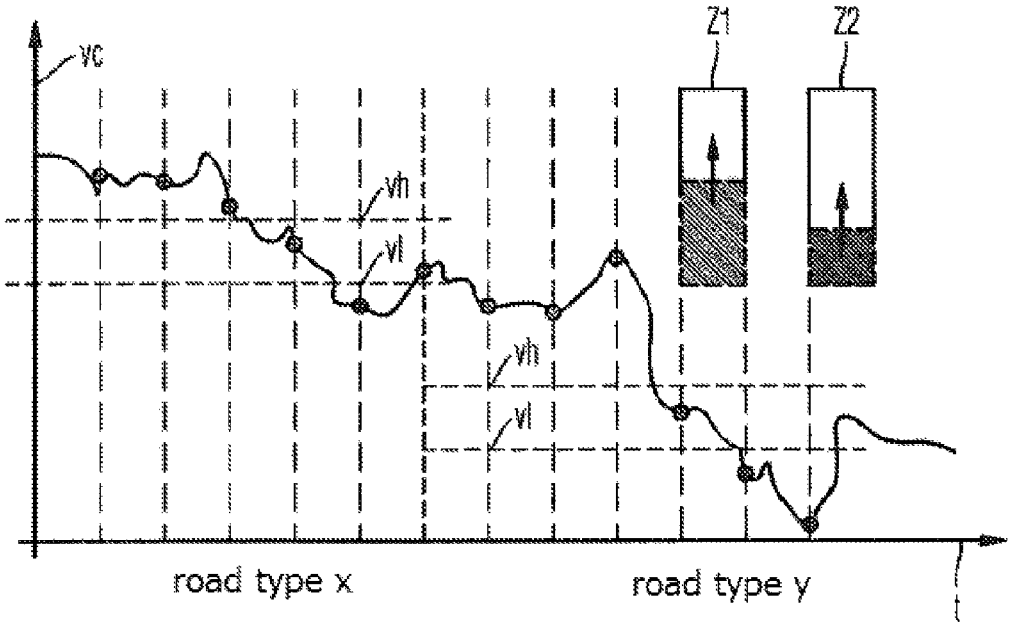
FIG. 4 shows a speed diagram for a vehicle.

The function of the first program function PF1 in combination with the second program function PF2 will be described hereafter on the basis of FIGS. 4 and 5. FIG. 4 shows a speed diagram of the vehicle. The speed is acquired once at predefined time intervals, for example, the speed is acquired in each case at equal time intervals, for example, of one second, once in each case. For the traffic status recognition, for example, two counters are used, and an upper speed threshold vh and a lower speed threshold vl. The upper speed threshold vh and the lower speed threshold vl can be ascertained, for example, by means of the second program module 102 and the third program module 103. Alternatively, it is possible that only one or more than two speed thresholds are used.

For example, depending on an acquired position of the vehicle and predefined digital roadmap data, a road and/or a road type can be ascertained, on which the vehicle is currently moving, and depending on the road or the road type, respectively, the at least one speed threshold can be ascertained. FIG. 4 shows as an example in each case the upper speed threshold vh and the lower speed threshold vl for two road types.

The respective acquired speed vc is assigned to a first speed range, when the respective acquired speed vc of the vehicle is greater than the predefined upper speed threshold vh. A first count Z1 is increased when the respective acquired speed vc is assigned to the first speed range. The respective acquired speed vc is assigned to a second speed range when the respective acquired speed vc of the vehicle is less than the predefined lower speed threshold vl. Furthermore, a second count Z2 is increased when the respective acquired speed vc is assigned to the second speed range, wherein the holding phases Tv0 are specially considered, during which the respective acquired speed vc of the vehicle has a speed value in a predefined range around the value zero once or multiple times in sequence. The predefined range can comprise, for example, speeds in the range of 0 to 0.5 km/s.

Figure 5:
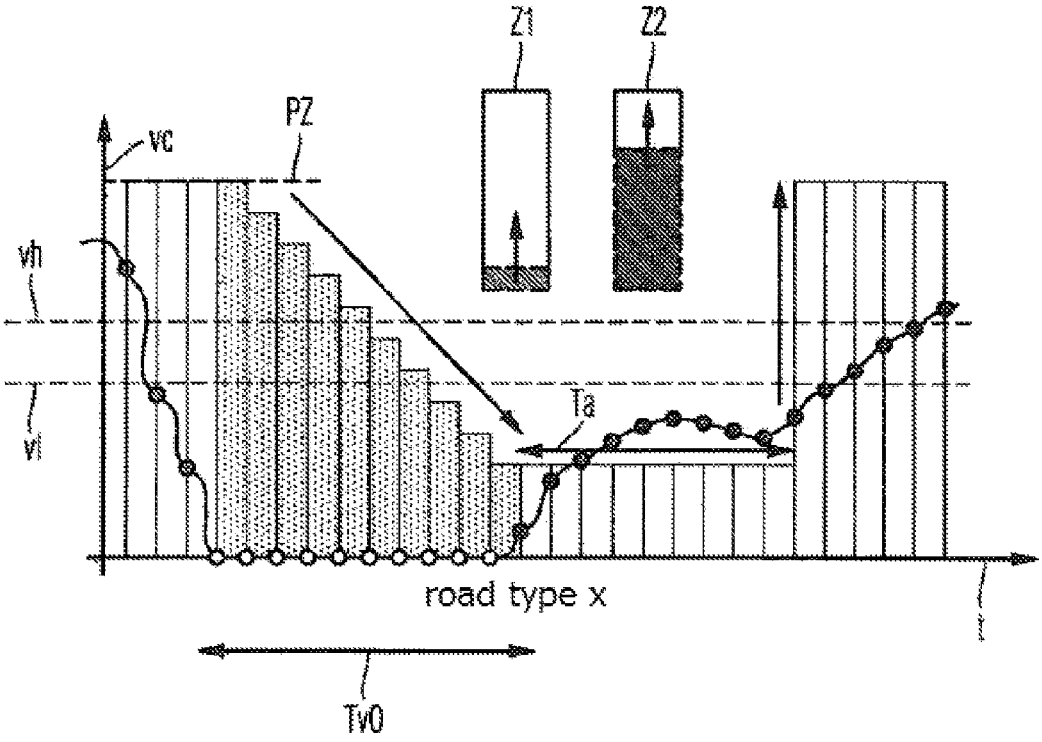
FIG. 5 shows a speed diagram for a vehicle having a holding phase.

The consideration of the holding phases Tv0 is shown in particular in FIG. 5. In order that the holding phases Tv0, which can be caused, inter alia, by stopping at traffic signal systems and/or intersection regions, do not result in an incorrect increase of the second count Z2, which can also be referred to as a congestion account, it is provided that respective holding phases Tv0 up to a respective predefined duration do not result in an increase of the congestion account. For this purpose, a holding phase Tv0 is recognized and during the recognized holding phase Tv0, the acquired speeds vc having the speed value in the predefined range around the value zero are not considered for a predefined non-consideration number of speed acquisition periods during the adaptation of the second count Z2.

For this purpose it can be provided, for example, that the non-consideration number per holding phase Tv0 is fixedly predefined. Alternatively, it can be provided in particular that the non-consideration number is ascertained depending on a duration of at least one preceding holding phase of the vehicle and/or depending on a time span which lies between the at least one preceding holding phase and the holding phase Tv0.

For example, a buffer count PZ can be used for this purpose. After an initialization, the buffer count PZ has, for example, a maximum buffer count value. During the recognized holding phase Tv0, the buffer count PZ, in each case per acquired speed vc, is reduced by a predefined first value, for example, by one, but at most until the buffer count PZ has the value zero. During this time, the second count Z2 is not increased, although the acquired speed vc is less than the lower speed threshold vl. However, if the holding phase Tv0 still continues when the buffer count PZ already has the value zero, the second count Z2 is increased for the further acquired speeds vc during the holding phase Tv0.

If the vehicle accelerates and/or travels after the holding phase Tv0 and therefore the acquired speeds vc have a speed value outside the predefined range around the value zero, the buffer count PZ initially maintains its current value. If the vehicle travels for a predefined starting duration Ta after the holding phase Tv0, so that the acquired speeds vc continuously have a speed value outside the predefined range around the value zero, the buffer count PZ is newly initialized with the maximum buffer count. If the vehicle travels for a shorter time than the predefined starting duration Ta after the holding phase Tv0, so that the acquired speeds vc continuously have a speed value outside the predefined range around the value zero, the buffer count PZ is not newly initialized, but rather it is reduced further during the current holding phase Tv0, for example, proceeding from the value which it has after the directly preceding holding phase.

Alternatively or additionally, it can be provided that the non-consideration number of speed acquisition periods of the respective holding phase Tv0, which are not taken into consideration, is ascertained depending on a turn signal status of the vehicle and/or a recognized lane on which the vehicle is located. In this manner, it can be taken into consideration in particular that the holding phase Tv0 can lengthen at a traffic signal system and at an intersection when the vehicle wishes to turn to the left in the case of general right-hand traffic, for example.

For this purpose, it can be provided, for example, that the buffer count PZ is correspondingly reduced more slowly. For example, it can be provided that the value with which the buffer count PZ is reduced is adapted depending on the turn signal status of the vehicle and/or the recognized lane. For example, it can be provided that when it is recognized depending on the turn signal status and/or the recognized lane that, for example, the vehicle intends to turn to the left in the case of general right-hand traffic, the buffer count PZ is only reduced in each case by the value 0.5, for example.

Figure 6:
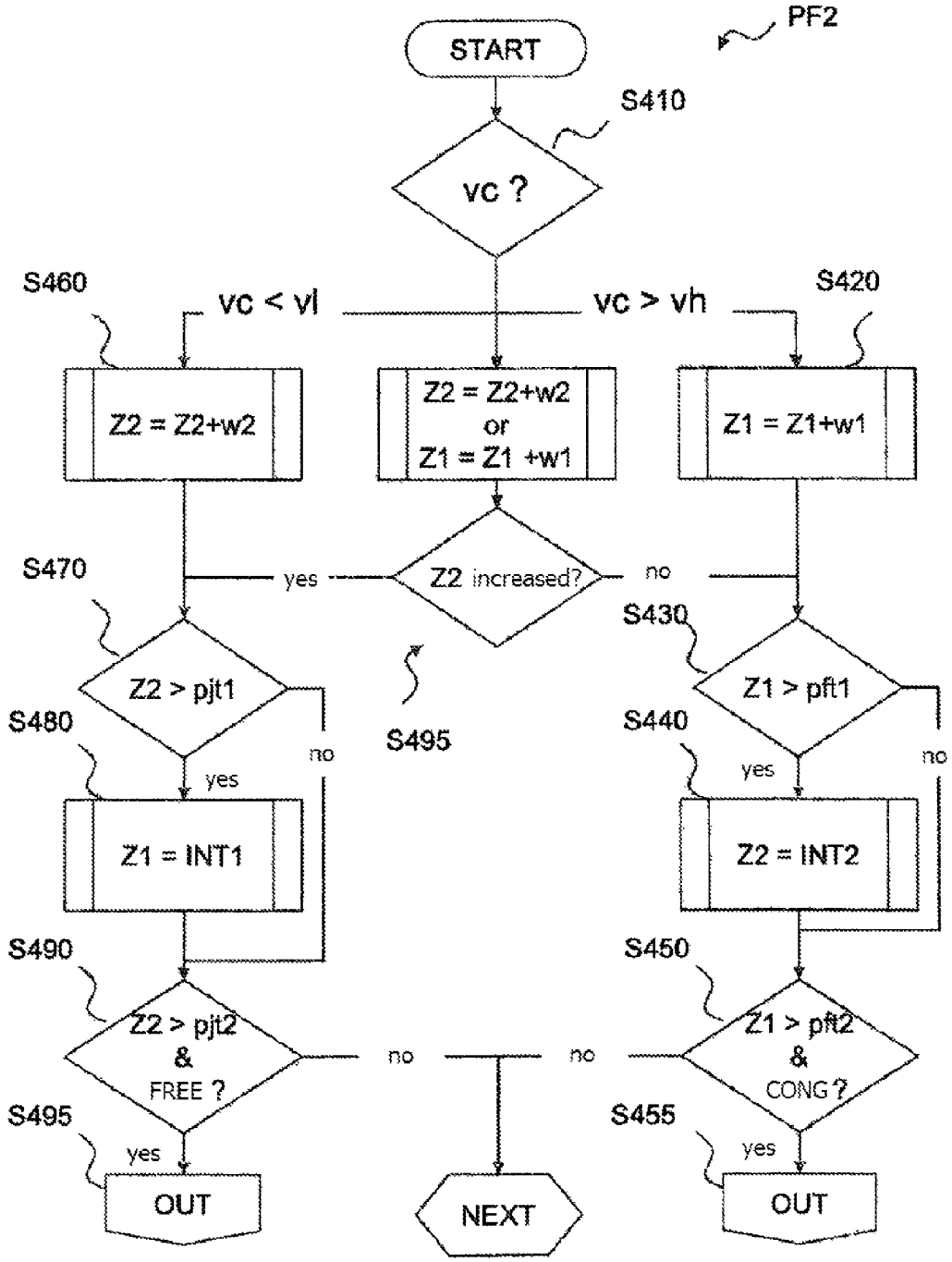
FIG. 6 shows a flow chart of a second program function.

In addition, FIG. 6 shows as an example a flow chart for the second program function PF2 for the ascertainment of the first count Z1 and the second count Z2 according to a first threshold value method.

In a step 410, it is checked whether the acquired speed vc of the vehicle, for example, the current actual speed of the vehicle, is greater than the upper speed threshold vh, or whether the acquired speed vc of the vehicle is less than the lower speed threshold vl, or whether the acquired speed vc is less than the upper speed threshold vh, but is greater than the lower speed threshold vl.

If the respective acquired speed vc of the vehicle is greater than the upper speed threshold vh, the acquired speed vc is assigned in a step 420 to the first speed range and the first count Z1 is increased, for example, by a predefined first incrementing value w1, which is equal to one, for example.

In a step 430, it is checked whether the first count Z1 exceeds a predefined first threshold value pft1. If the first count Z1 exceeds the predefined first threshold value pft1, a predefined second initialization value INT2 is assigned to the second count Z2 in a step 440. The second initialization value INT2 can be equal to zero.

In a step 450, the first traffic status FREE is recognized when the first count Z1 exceeds a predefined first limiting value pft2. Furthermore, it is checked in step S450 whether a change from the second traffic status CONG to the first traffic status FREE is present. If both conditions are met, the result is transferred in a step S455 to the fifth program module 105.

If the two conditions are not met simultaneously, the second program function PF2 can be continued by means of a next loop NEXT in step 410 for the subsequently acquired speed.

If it is recognized in step S410 that the respective acquired speed vc of the vehicle is less than the lower speed threshold vl, the acquired speed vc is assigned in step 460 to the second speed range and the second count Z2 is increased, for example, increased by a predefined second incrementing value w2, which is equal to one, for example. The first incrementing value w1 and the second incrementing value w2 for the first count Z1 and the second count Z2 are preferably selected to be equal.

In a step 470, it is checked whether the second count Z2 exceeds a predefined second threshold value pjt1. If the second count Z2 exceeds the predefined second threshold value pjt1, the first count Z1 is assigned a predefined first initialization value INT1 in a step 480. The first initialization value INT1 can be equal to zero.

In a step 490, the second traffic status CONG is recognized when the second count Z2 exceeds a predefined second limiting value pjt2. Furthermore, it is checked in step S490 whether a change is present from the first traffic status FREE to the second traffic status CONG. If both conditions are met, the result is transferred in a step S495 to the fifth program module 105.

If the two conditions are not met simultaneously, the second program function PF2 can be continued by means of a next loop NEXT in step 410 for the subsequently acquired speed.

If it is recognized in step S410 that the respective acquired speed vc of the vehicle is less than the upper speed threshold vh and is greater than the lower speed threshold vl, the acquired speed vc is assigned in step 495 to the first speed range when the immediately previously acquired speed was assigned to the first speed range. The second program function PF2 is continued in this case in step S430. In contrast, if the immediately previously acquired speed was assigned to the second speed range, in step 495, the acquired speed vc is assigned to the second speed range and the second program function PF2 is continued in this case in step S470.

The second program function PF2 for ascertaining the first count Z1 and the second count Z2 according to the first threshold value method can also be used independently of the first program function PF1 of the fourth program module 104, for example, when a separate intersection region recognition is provided.

Alternatively, for the second program function PF2 for the ascertainment of the first count Z1 and the second count Z2, for example, a second threshold value method can be used, in which, for example, the acquired speed vc is assigned to the first and the second speed ranges equally, when it is less than the upper speed threshold vh and is greater than the lower speed threshold vl. A further possible embodiment of the second program function PF2 is described in the PCT patent application having the international publication number WO 2005/064567 A1 in FIG. 5 and the associated description, in particular on page 17, line 6 to page 21, line 14. The content of FIG. 5 and page 17, line 6 to page 21, line 14 of the PCT patent application having the international publication number WO 2005/064567 A1 is hereby incorporated.

Alternatively, for the second program function PF2 for the ascertainment of the first count Z1 and the second count Z2, for example, a third threshold value method can be used, in which the acquired speed vc is not assigned to the first or the second speed range if it is less than the upper speed threshold value vh and is greater than the lower speed threshold value vl.

LIST OF REFERENCE NUMERALS

10 program
101 first program module
102 second program module
103 third program module
104 fourth program module
105 fifth program module
DATA1 first data set
DATA2 second data set
DATA3 third data set
FREE first traffic status
INT1 first initialization value
INT2 second initialization value
PF1 first program function
PF2 second program function
pft1 first threshold value
pft2 first limiting value
pjt1 second threshold value
pjt2 second limiting value
PZ buffer count
CONG second traffic status
t time axis
Ta starting duration
Tv0 holding phase
vc acquired speed
ve expected speed
vh upper speed threshold
vl lower speed threshold
vm average speed of vehicle
w1 first incrementing value
w2 second incrementing value
Z1 first count
Z2 second count The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A computer-implemented method for ascertaining traffic status, the method comprising iteratively performing the following sequence at predefined time intervals defining a speed acquisition period via a software program executed by an on-vehicle computer:

acquiring a speed of the vehicle via a speed sensor communicatively coupled to the computer;

assigning the acquired speed to a speed range, including at least one of:

a first speed range, when the acquired speed is greater than at least one speed threshold, a second speed range, when the acquired speed is less than the at least one speed threshold but greater than a minimum speed threshold, a third speed range, when the acquired speed is less than the minimum speed threshold;

adjusting a respective count of a counter such that:

a first count is adjusted if the respective acquired speed is assigned to the first speed range, a second count is adjusted if the respective acquired speed is assigned to the second speed range, and no count is adjusted if the respective acquired speed is assigned to the third speed range;

determining a holding phase based on whether the acquired speed is assigned to the third speed range and a prior acquired speed associated with one or more immediately preceding iterations was also assigned to the third speed range;

modifying the adjusting step for one or more subsequent iterations based on the determination, such that no count is adjusted for a predetermined non-consideration number of speed acquisition periods;

determining a flowing traffic status when the first count exceeds a first value before the second count exceeds a second value; and determining a congested traffic status when the second count exceeds the second value before the first count exceeds the first value.

2. The method according to claim 1, wherein the acquired speed is a current speed of the vehicle.

3. The method according to claim 1, wherein the non-consideration number is fixedly predefined per holding phase.

4. The method according to claim 1, wherein the non-consideration number is ascertained based on at least one of: a duration of at least one preceding holding phase, and a time span between the at least one preceding holding phase and the holding phase.

5. The method according to claim 1, wherein the non-consideration number is ascertained based on at least one of: a turn signal status of the vehicle and a recognized lane on which the vehicle is located.

6. The method according to claim 2, wherein the non-consideration number is ascertained based on at least one of a turn signal status of the vehicle and a recognized lane on which the vehicle is located.

7. The method according to claim 4, wherein the non-consideration number is based on at least one of a turn signal status of the vehicle and a recognized lane on which the vehicle is located.

8. The method according to claim 1, further comprising:

ascertaining a road and/or a road type, on which the vehicle is currently moving, based on an acquired position of the vehicle and a predefined digital roadmap data; and establishing the at least one speed threshold based on the road and/or the road type.

9. The method according to claim 7, further comprising:

ascertaining a road and/or a road type, on which the vehicle is currently moving, based on an acquired position of the vehicle and a predefined digital roadmap data; and establishing the at least one speed threshold based on the road and/or the road type.

10. The method according claim 1, further comprising: determining the at least one speed threshold based on at least one traffic influence that is expected to result in a reduction of vehicle speed.

11. The method according to claim 1, wherein the non-consideration number is ascertained based on whether the vehicle is currently located in to an urban or a rural region.

12. The method according to one of claim 8, wherein the method further comprises:

establishing an upper speed threshold based on the road and/or the road type, wherein assigning the acquired speed to the speed range further comprises:

assigning the acquired speed to the first speed range, when the acquired speed is greater than the upper speed threshold, and assigning the acquired speed to the second speed range, when the acquired speed is less than the lower speed threshold.

13. The method according to one of claim 9, wherein the method further comprises:

establishing an upper speed threshold based on the road and/or the road type, wherein assigning the acquired speed to the speed range further comprises:

assigning the acquired speed to the first speed range, when the acquired speed is greater than the upper speed threshold, and assigning the acquired speed to the second speed range, when the acquired speed is less than the lower speed threshold.

14. The method according to claim 12, wherein the acquired speed is assigned to the second speed range when it is less than the upper speed threshold but is greater than the lower speed threshold, and when the immediately prior acquired speed was assigned to the second speed range, and wherein the acquired speed is assigned to the first speed range when it is less than the upper speed threshold but is greater than the lower speed threshold, and when the immediately prior acquired speed is was assigned to the first speed range.

15. The method according to claim 12, wherein the acquired speed is assigned both the first speed range and the second speed range when the acquired speed is less than the upper speed threshold and is greater than the lower speed threshold.

16. The method according to claim 12, wherein the acquired speed is not assigned to the first speed range or the second speed range when it is less than the upper speed threshold, but is greater than the lower speed threshold.

17. The method according to claim 1, further comprising:

assigning a first initialization value to the first count when the second count exceeds a second threshold value, and assigning a second initialization value to the second count when the first count exceeds a first threshold value.

18. The method according to claim 1, further comprising:

detecting a change in traffic status between the flowing traffic status and the congested traffic status;

transmitting, based on the detected change in traffic status, an ascertained data set representing the changed traffic status to a central unit.

19. A device for ascertaining traffic status, comprising:

a speed sensor for sensing the speed of a vehicle;

an on-vehicle processor communicatively coupled to the speed sensor, the processor configured to execute the following process iteratively and in accordance with time intervals defining a speed acquisition period:

acquiring a speed of the vehicle via the speed sensor;

assigning the acquired speed to a speed range, including at least one of:

a first speed range, when the acquired speed is greater than at least one speed threshold, a second speed range, when the acquired speed is less than the at least one speed threshold but greater than a minimum speed threshold, a third speed range, when the acquired speed is less than the minimum speed threshold;

adjusting a respective count of a counter such that:

a first count is adjusted if the respective acquired speed is assigned to the first speed range, a second count is adjusted if the respective acquired speed is assigned to the second speed range, and no count is adjusted if the respective acquired speed is assigned to the third speed range;

determining a holding phase based on whether the acquired speed is assigned to the third speed range and a prior acquired speed associated with one or more immediately preceding iterations was also assigned to the third speed range;

modifying the adjusting step for one or more subsequent iterations based on the determination, such that no count is adjusted for a predetermined non-consideration number of speed acquisition periods;

determining a flowing traffic status when the first count exceeds a first value before the second count exceeds a second value; and determining a congested traffic status when the second count exceeds the second value before the first count exceeds the first value.

* * * * *